United States Patent [19]

Williams

[11] Patent Number: 5,018,456

[45] Date of Patent: May 28, 1991

[54] SYSTEM FOR DISPOSING OF SLUDGE

[75] Inventor: Robert M. Williams, Ladue, Mo.

[73] Assignee: Williams Patent Crusher and Pulverizer Company, St. Louis, Mo.

[21] Appl. No.: 314,895

[22] Filed: Feb. 24, 1989

[51] Int. Cl.[5] ..... F23G 5/33

[52] U.S. Cl. ..... 110/342; 110/238; 110/224; 110/222; 110/346

[58] Field of Search ..... 110/238, 222, 224, 254, 110/160, 342, 346

[56] References Cited

U.S. PATENT DOCUMENTS

| | | | |
|---|---|---|---|
| 2,102,427 | 12/1937 | Lloyd et al. | 110/224 |
| 2,148,447 | 2/1939 | Dundas et al. | 110/222 |
| 2,213,668 | 9/1940 | Dundas et al. | 110/222 |
| 3,826,208 | 7/1974 | Williams | 110/222 |
| 4,121,524 | 10/1978 | Voelskow et al. | 110/222 |

*Primary Examiner*—Henry C. Yuen

*Attorney, Agent, or Firm*—Gravely, Lieder & Woodruff

[57] ABSTRACT

A system for disposing of sludge by using the sludge as a primary source of fuel for its disposition by combustion thereof in which a mass of liquified sludge is processed to reduce the solids to a predetermined size for use as the fuel and concurrently separating a substantial portion of the contained liquid, delivering the processed solids and liquids to a combustor for converting the solids to ash and converting the liquids to vapor, introducing ambient air to the combustor to support combustion of the solids while employing a portion of the ambient air to the combustor for removing the vapor at a temperature below the temperature at which the solids are reduced to ash, utilizing a portion of the vapor removed from the combustor to initiate vaporization of the liquid in the mass of liquified sludge being processed initially, using a part of the removed vapor to enter into a heat exchange relationship with the ambient air prior to its being admitted to the combustor, and releasing excess vapor to the ambient atmosphere at a temperature for sanitizing the released vapor to the ambient atmosphere.

12 Claims, 2 Drawing Sheets

SYSTEM FOR DISPOSING OF SLUDGE

BACKGROUND OF THE INVENTION

1. Field of the Invention

The present invention is directed to a system for disposing of wet sludge by using a dried or partially dried sludge as a fuel for its own description.

2. Description of the Prior Art

There is a continuing problem in how to effectively dispose of raw wet sludge in other than land fill approaches or by expensive and sometimes inefficient fluid bed combustors. The known prior art is limited in its disclosure to only portions of the present problems.

Attempts have been made to dispose of sludge by first drying the moisture from the sludge and then conveying it into combustion equipment where outside fuel is necessary to be supplied in order to sufficiently dry the sludge to a condition where it can be carted away to a land fill installation, or otherwise disposed of. Examples of prior art include: U.S. Pat. No. 4,593,477, date of patent Jun. 10, 1986; U.S. Pat. No. 4,608,944 date of patent Sep. 2, 1986; U.S. Pat. No. 4,628,838, date of patent Dec. 16, 1986; U.S. Pat. No. 4,633,818 date of patent Jan. 6, 1987; U.S. Pat. No. 4,646,637, date of patent Mar. 3, 1987; U.S. Pat. No. 4,671,251, date of patent Jun. 9, 1987.

A BRIEF SUMMARY OF THE INVENTION

The invention is directed to a system, the object of which is to handle wet sludge in a first stage where it can be prepared by partial evaporation and separation of the component of moisture so combustion can be initiated in a second stage, and to treat the moisture that is extracted so that the residue of the sludge solids that still remains in that moisture can be supplied to a combustor which constitutes an important part of the second stage to support the destructive combustion of the partially dried or dried sludge. The present invention has as a primary object the self destruction by combustion of most any character of sludge from sources such as sewage, paper mill sludge to identify two types of sources of sludge.

It is a further object of the present invention to treat sludge in a first staged system that prepares the sludge and any moisture component for subsequent reduction in a second staged combustion step by utilizing sludge that has been ground to a proper fuel size as the fuel in a combustion zone where the moisture is converted to a vapor at a temperature that produces an activated carbon conversion of the solids in the sludge, whereby the by-product of the present invention gets rid of the liquid and vapor components at a temperature that sanitizes the components and does not pollute the ambient atmosphere when so released, and also produces an activated carbon by-product which is highly useful for neutralizing the heavy metal components which are discarded in land fill operations.

Still another object of the present invention is to regulate the temperature and condition of the moisture in the system so that a proportion of the vapor discharged from the combustor can be returned to the initial grinding mill for effecting partial drying of the incoming wet sludge, part of the discharge from the combustor can be utilized to raise the temperature of the combustion supporting ambient air, and a residual portion can be utilized to drop the temperature in a final step to a level that will not be destructive of a bag house where the fine particulate matter is extracted while the vapor is returned to the ambient air and is mixed with a supply of air that has been raised in temperature to an oxidizing level for discharge to the ambient atmosphere with the emission from the bag house.

The system also contemplates as an important object the combustion of the sludge using conventional coal burning technique with certain improvements to obtain greater efficiency in using the prepared sludge material as its own fuel, thereby effecting disposal of wet sludge by a self preparation technique to support combustion thereof.

BRIEF DESCRIPTION OF THE DRAWINGS EMBODIMENT FOR THIS INVENTION

The system of this invention is disclosed in

FIG. 1 which is a schematic diagram arranged to provide a two part system to be explained in detail hereinafter;

FIG. 2 is a fragmentary sectional view of certain components employed in the system seen in FIG. 1 the view being taken along line 2—2 in FIG. 1; and FIG. 3 is a fragmentary portion of the system disclosed in FIG. 1 in order to illustrate a modification of the system in FIG. 1.

DETAILED DESCRIPTION OF THE PREFERRED EMBODIMENT

Figure 1:
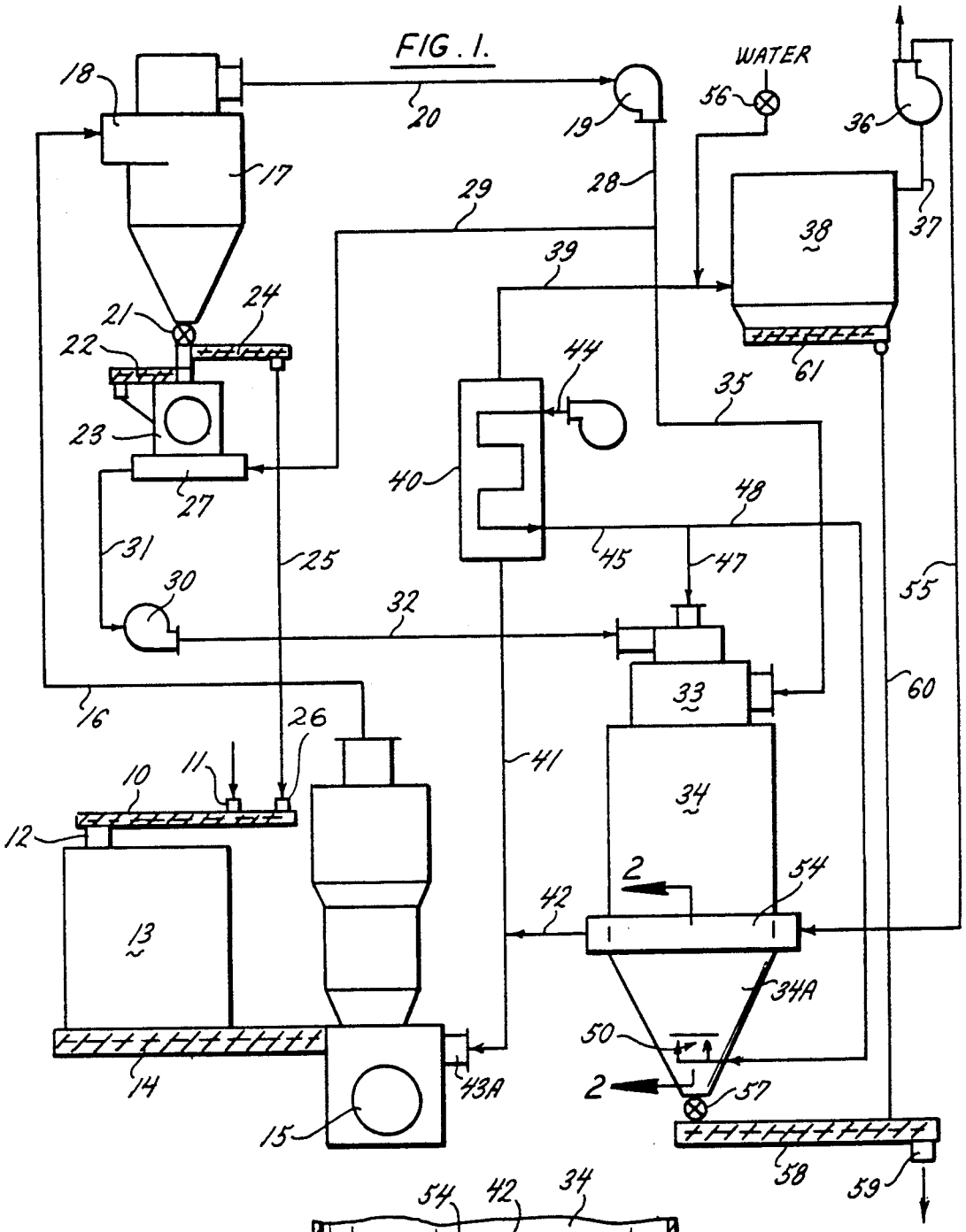

In the schematic view of the accompanied drawing FIG. 1, there is disclosed a system organization in which raw sludge, that may have a moisture content as high as 80% moisture and 20% solids, is fed into a suitable screw conveyor 10 at the inlet 11 thereof. The outlet 12 from the screw conveyor delivers the sludge into a holding bin 13, and the bottom of the bin 13 is equipped with a suitable screw conveyor 14 which delivers the sludge material into an impact grinding mill 15. The processing of the sludge in the impact mill 15 proceeds in a known manner to result in the reduced sludge being passed through a conduit 16 into a cyclone separator 17. The top 18 of the cyclone separator is connected to the inlet side of a primary fan 19.

It is intended that the operation of the primary fan 19 will draw the processed material through conduit 16 from the impact grinding mill 15 and cause it to be separated in the cyclone separator 17 so that the air and gases are fed into the primary fan 19 through a conduit 20. The more or less solid residue in the cyclone separator 17 is passed through a rotary control gate 21 for deposit either through a screw conveyor 22 into a secondary impact crusher 23, or through a suitable screw conveyor 24 and to a discharge conduit 25 which is connected into a secondary inlet 26 at the previously identified screw conveyor 10. This step in the system mixes wet incoming sludge at inlet 11 with semi-prepared sludge from conduit 25 so that the mixed sludge material exiting the screw conveyor at 12 will be conditionally prepared by the resulting mixture that enables the sludge material in the bin 13 to have its moisture content reduced to approximately a 50% moisture to 50% solids ratio.

The sludge material that is processed in the secondary mill 23 is moved through its outlet 27 by a portion of the air/or gases from the outlet conduit 28 of the primary fan 19 to be directed through a conduit 29 connected to the outlet 27 of the secondary grinder mill 23. The material moved in this manner is also assisted in its movement by a second fan 30 inserted in a conduit 31 to move the material from the mill 23 to its outlet conduit 32 and into the burner device 33 operatively associated with a suitable combustor 34 where it becomes a partial supporter of combustion in the furnace 34.

The gas moved in the conduit 28 from primary fan 19 also flows through a conduit system 35 and into the burner 33 where it will join with the ground material supplied to the burner 33 from conduit 32.

The combustor 34 and the items of equipment associated therewith make up a second system for effectively disposing, in a somewhat final manner, of the sludge as ash. The second system comprises an exhaust fan 36 at the outlet stack 36S associated with the outlet 37 from a bag house 38 which is connected up by conduit 39 leading from a heat exchanger device 40, and that heat exchanger 40 is connected by a conduit 41 to the outlet conduit 42 from the combustor 34. The connection of the conduit 42 to the conduit 41 is at a junction where the combustor outlet can split and flow into a branch conduit 43 leading back into an inlet connection 43A at the impact mill 15. The exit conduit 42 of the furnace 34 supplies hot oases and particulates to conduit 43 and 41, and heat carried into conduit 41 flows through the heat exchanger 40 for the purpose of raising the temperature of the ambient air admitted at inlet 44 to a temperature at the outlet 45 that can be useful in two ways. One way is to connect the outlet 45 to a conduit 47 to direct air into the burner 33. The excess air can be by-passed by a conduit 48 to the bottom end portion 34A of the combustor 34.

The combustor 34 is a fire brick lined structure which is capable of using the gases and air, and the fuel admitting to the burner 33 to support combustion and develop at least a temperature of the order of 1650° F. that will effectively sanitize the gases which are normally objectionable because its a sewer sludge type material. As pointed out above, the burner 33 is supplied with fine particulate matter through conduit 32 from the fan 30 so that such material acts as the fuel to support combustion. Also there may be some very fine particulate material drawn through the primary fan 19 and that is transmitted to the burner 33 through the conduit 35, as previously pointed out, and such particulate matter also acts as a fuel to support combustion. Thus there are two ways of moving the sludge from the impact mill 15 into the combustor 34, one is by way of conduit 32 and the other is by conduit 35.

The operation of the combustor 34 involves the provision in the bottom portion 34A of one or more bubbling bed 50 which embody a conduit 51 with one or more upwardly directed outlets 52 to deliver the excess heated fresh air supplied through conduit 48 into and beneath a cover 53. The cover 53 is directed with its closed side upwardly so that the ash is in a combustion state in the combustor 34 cannot fall into the outlets 52 and thereby plug one or more of the outlets. On the other hand, the air can make the necessary reverse flow movement and escape from under the cover 53 and move upwardly through the body of burning material or ash which is moved down from the upper portion of the furnace 34, thereby providing a bubbling bed at 50.

It can be seen in the schematic view that the furnace is provided with a transverse windbox device 54 which is a pipe member that is open at the bottom and is positioned to conduct a portion of the air exhausted by fan 36 and received through conduit 55 to move the products of combustion out of the combustor 34 and into the outlet conduit 42 previously identified. A portion of the material in the outlet 42 that has been cooled in the portion 34A of the combustor 34 can be directed through conduit 43 and into the inlet 43A at the mill 15, while another portion may be drawn through the conduit 41 by operation of the discharge blower or fan 36. The division of the material passing out through conduit 42 and into conduits 41 and 43 can be proportioned in relation to the speed of the blower or fan 36.

The portion of the material passing the outlet from the combustor base 34A that passes through conduit 41 and through the heat exchanger 40, but may have a temperature at the outlet conduit 39 that is too high and therefore destructive of the bag elements in the bag house 38. In order to control the temperature of the flow through the conduit 39 there is provided a water nozzle device 56 that will admit to conduit 39 a desired quantity of water so that the temperature of the flow in conduit 39 can be brought down to a range of the order of 350° F.

It should now be apparent from the foregoing description of the schematic disclosure of a presently preferred embodiment of apparatus that the wet sludge material delivered at the system inlet 11 is initially prepared for its self destruction through the combined operation of the impact grinder mill 15 where hot gases at approximately 1200° F. enter at the inlet 43A to partially dry the sludge while it is simultaneously being grounded to reduce it to a suitable fuel size. The output from the mill 15 is processed in a cyclone device 17 where the semi dried material is discharged through a rotary valve 21 so that some of the material can be recycled back by screw conveyor 24 and conduit to the mixing screw conveyor 10 so as to effectively provide a condition of the sludge material in the bin 13 to a moisture level of approximately 50% water.

The material collected in the bottom of the cyclone separator 17 can be divided between the grinder mill 23 to reduce it to the desired fuel size while some of that material collected in the cyclone separator 17 can be directed back to the inlet side of the bin 13 at the mixing screw conveyor 10.

It is desired to operate the combustor 34 at a heat level of about 1650° F. so that the material used as a fuel to support that level of combustion will be at that temperature for at least a few seconds in order to render the contained gases hygienic and odor free.

As indicated in the schematic view the combustor base section 34A is provided with a rotary exhaust valve 57 which is connected into a screw conveyor 58 which will move the residue discharged from the base section 34A outlet end where there is located a combustion analyzer device 59. The device 59 is intended to detect if the combustion of the particulate material in the combustor 34 is either complete or not complete. If the material is incompletely consumed the rotary valve 57 can be slowed down to require a longer period of residence of the material in the combustor bubbling bed device portion 34A so as to subject the ash material to more complete combustion and, thereby, force a greater portion of the ash to travel to the bag house by way of conduit 41, heat exchanger 40 and conduit 39. Since the fuel material that is not adequately burned is heavier than the ash material it will be subject to a longer period of time at approximately 1400° F. in the lower zone of the combustor 34, and this longer residence period will expose the fuel material to a longer exposure to oxygen that is released from the bubbling bed device 50.

In the operation of the system of FIG. 1, the combustion of the sludge in combustor 34 is sustained by supplying fresh air from the heat exchanger 40 by conduit 45 and 47. The excess air is by passed into conduit 48 which supplies the bubbling bed device 50. The combustion of the sludge in the bottom 34A of the combustor 34 is carried on at a lower temperature than is present in the upper area 34 of the combustor. The heat of combustion is carried out of the bottom 34A of the combustor 34 by gases circulated through the windbox 54. The gases leaving the windbox 54 is divided at the connection 42, part flowing to the heat exchanger 40 by conduit 41 and part going by conduit 43 to the primary impact mill 15.

The gas directed to the primary mill 15 is at a temperature which partly evaporates the moisture in the sludge fed to that primary mill, and also acts as a conveying medium to carry the primary mill output through conduit 16 to the cyclone separator 17. The separator 17 releases the moisture laden gases to conduit 20 which is connected to the primary fan 19, and the solids pass out through the rotary gate 21. Part of the solids are received in the secondary mill 23, and part are moved by a screw conveyor 24 into conduit 25 which returns that part back to be moved with the screw conveyor 10 for mixing with fresh incoming sludge. The effect of this mixing is to reduce the moisture content of the material being ground in the mill 15.

Figure 2:
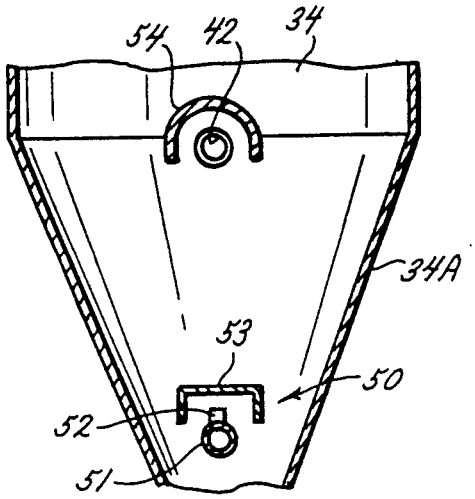

The separator 17 is provided with an outlet 20 which is connected to the primary fan 19. The medium thus conveyed is used to supply the output 27 of the secondary mill 23 and by fan 30 which then moves it into the burner device 33 by conduit 32. It is to be remembered that part of the output from the primary fan 19 is diverted by conduit 35 and is delivered to the burner 33. At the same time the burner 33 receives sufficient oxygen from the conduit 47 and 48 to maintain the burning of the solids delivered by conduits 32 and 35. However the moisture reaching the combustor 34 is evaporated and released as vapor through conduit 42, as before explained. Because of the moisture in the material fed into the burner 33 and the recycling water evaporated in the primary stage and entering the burner 33 by way of conduits 32 and 35, the combustion temperature is at a level of about 1650° F. which is well below the temperature needed to generate nitrous oxide (Nox). Thus, the present system of FIGS. 1 and 2 is able to reduce the sludge solids to sanitized ash, and to sanitize the moisture vapor which is partly recirculated in the first part of the system associated with the primary and secondary mills 15 and 23.

Figure 3:
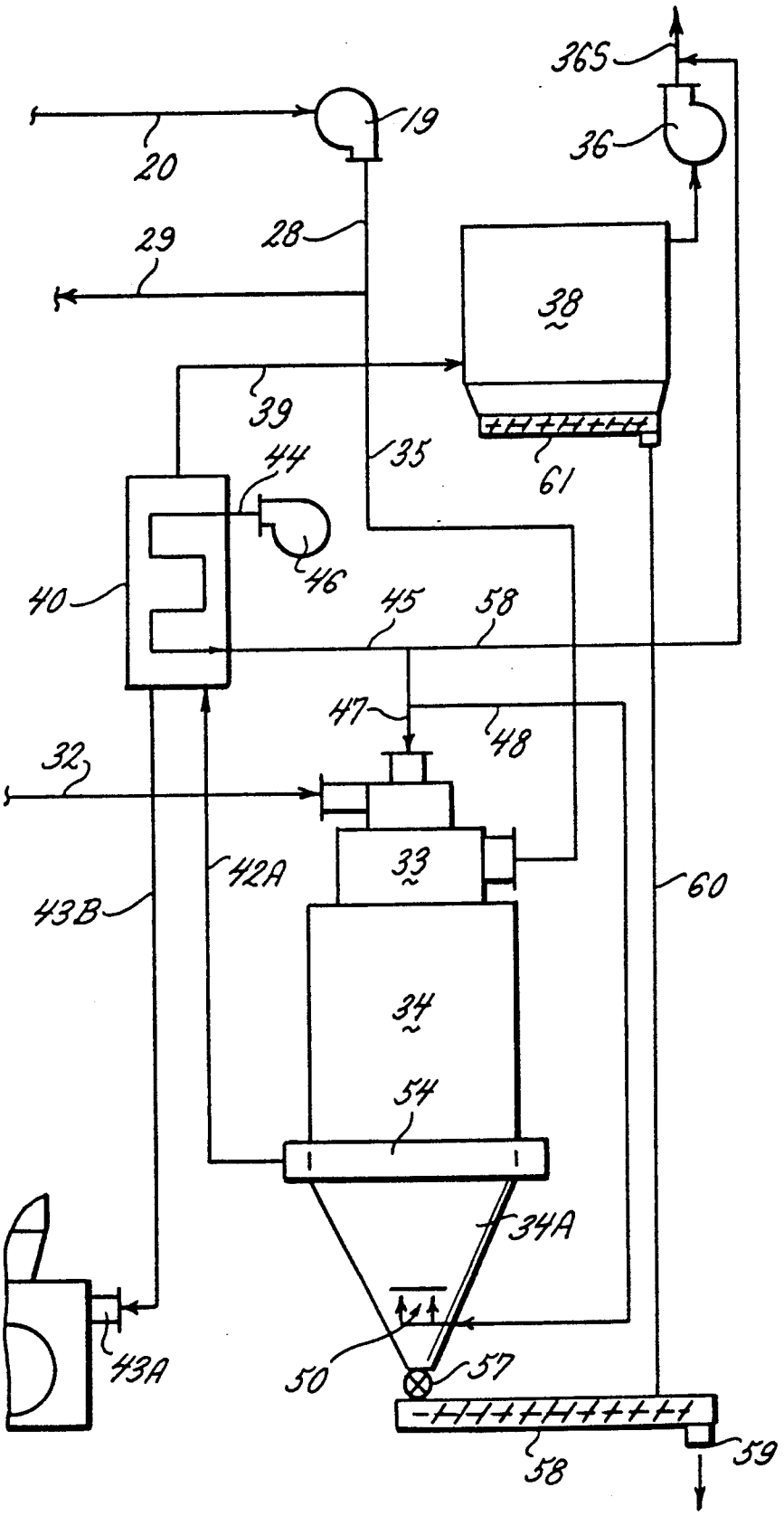

Turning now to FIG. 3 there is shown a modified system which is associated with some of the components of the system illustrated in FIG. 1. Accordingly where the modified system of FIG. 3 utilizing any part of the system of FIG. 1, similar reference numerals will be utilized to show the connection thereof.

In FIG. 3 the main fan 19 is intended through its inlet conduit 20 to create a circulation system where the gaseous and vapor components from the cyclone separator 17 reach the fan through conduit 20. The operation of the fan 19 generates a suction effect on the inlet conduit 43A at the mill 15. Similarly the material previously prepared in the secondary mill 23 is moved by the fan 30 through conduit 32 into the combustion device 33 as indicated. Furthermore the gaseous and vapor components flowing through the outlet from the fan 19 through conduit 28 is divided and a portion thereof flows through branch conduit 29 while the remainder of the flow is conducted by conduit 35 and connects up to the burner 33 so that substantially all of the gaeous vapor reaching the combustor is converted to steam during combustion of the incoming ground material supplied through conduit 32 to the common burner 33. The operation of the combustor 34 is intended to be sustained at a level using approximately 5–9% oxygen so as to reduce the sludge material to an ash that is high in carbon content but low in oxygen so as to render the carbon activated as it is exposed to 1650° F. in combination with high moisture content which has been converted to steam.

As seen in FIG. 3 ambient air is supplied from the fan 46 into the heat exchanger 40, and at the same time the discharge from the wind box 54 of the combustor 34 is conducted by a conduit 42A directly to the heat exchanger 40 and after that higher temperature discharge has lost some of its temperature it is returned through a conduit 43B to the inlet 43A of the primary mill 15. If the temperature discharging by the windbox 54 is at a temperature of the order of 1430° F., after it passes through a portion of the heat exchanger 40, there is a connection of a conduit 43B to direct to the primary mill 15 a flow of heated vapor at a reduced temperature of approximately 1200° F. Since the ambient or fresh air introduced at the fan 46 into the heat exchanger 40 is raised in temperature it is clear that conduit 45 connected into the exchanger 40 directs the fresh air at a temperature of the order of about 900° F., to the burner 33. The final outlet from the exchanger 40 receives the outgoing vapor and any retained matter in conduit 39 at a temperature level of approximately 350° F. which is low enough not to produce any destructive reaction in the bag house 38. The flow of oxygen at 900° F. in the conduit 45 is partially conducted by conduit 47 into the burner 33; also a portion of that 900° F. air is by passed through conduit 48 into the bubbling bed device 50; and a third portion is conducted by conduit 58 to the outlet of the blower 36, to combine with the outlet to ambient air at a sufficiently high temperature to result in oxidizing the discharge from the bag house 38 so as to destroy any residual pollution before it escapes to the ambient atmosphere. In the system of FIG. 3, the hot vapor is released from the combustor base 34A at wind box 54 due to the bubbling bed device 50 forcing an out flow to conduit 42A.

There is shown in FIGS. 1 and 3 a connecting conduit 60 that directs the particulate matter collected from the bag house 38 in the screw conveyor 61 associated with the bag house 38 and directs it into the screw conveyor 58 which collects the particulate matter released by the rotary valve 57 from the bottom of the combustor 34A.

The modified system of FIG. 3 is effective to drop the temperature of the flow of vapor and particulate matter in conduit 39 to a level that will not be destructive of the bag house 38, and by means of a conduit 58 will be effective to oxidize the exhaust gases in the outlet stack 36S associated with the fan 36 by using some of the 900° F. discharge from the heat exchanger 40. This modified system establishes the combustion of the particulate matter in the combustor 34 at an oxygen level of between 5–9% oxygen, thereby being effective to convert the combustion of the particulate matter to high percentage activated carbon which results from the fact that the combustor 34 contains steam at high temperature since the system contains a high water content of the order of something like 60 to 80% of the infeed sludge which is brought to the system through the inlet 11.

It is recognized that the incoming sludge may, as a normal event contain 60% to 80% water and approximately 40% to 20% of solids. The present system of FIG. 1 or 3 is able to handle those quantities with a high degree of efficiency while utlizing its own solid materials as a fuel that meets one of the objects of the invention which is to self destruct the solid material in the combustor while sanitizing and discharging the vapor and water without polluting the ambient atmosphere. The system also produces a quantity of activated carbon and sanitized ash which is highly prized in land fill operations to combat the presence of heavy metals such as mercury, lead, and the like.

It can be appreciated from the foregoing details of the systems setting forth the subject invention that modifications may come to mind without departing from the scope of the invention.

What is claimed is:

1. In a system for disposing of sludge by using the sludge as a primary source of fuel for its disposition by combustion thereof, the system comprising the steps of:

(a) processing a mass of liquified sludge to reduce the solids to a predetermined size for use as the fuel and concurrently separating a substantial portion of the contained liquid as a water vapor;

(b) delivering the processed solids and liquid to the combustor such that the combustor contains the solids and the liquids in the processed mass for conversion of the solids to ash and the conversion of the liquids to vapor;

(c) admitting a portion of the ambient air to the burner to support combustion of the solids, and another portion of ambient air to the combustor for removing the vapor at a temperature below the temperature at which the solids are reduced to ash;

(d) utilizing a part of the removed vapor to initiate evaporization of the liquid in the processed mass, and a part of the removed vapor to elevate the temperature of the ambient air admitted to the burner and to the combustor;

(e) releasing the part of the removed vapor used to elevate the temperature of the admitted ambient air to the ambient atmosphere; and (f) removing the ash substantially free of vapor.

2. The system set forth in claim 1 wherein the processing of the mass of liquified sludge is performed in the first and second stages to obtain the predetermined size of the solids for use as the fuel.

3. The system set forth in claim 2 wherein the liquid part of the sludge mass is extracted substantially entirely in advance of the mass being processed in the second stage.

4. The system set forth in claim 2 wherein the liquid part of the sludge mass is extracted in advance of the mass being processed in the second stage, and the extracted liquid is applied to deliver the second stage processed mass to the combustor.

5. The system set forth in claim 1 wherein the combustor burns the solids in the mass to an ash condition and converts the liquid to steam, and the portion of the admitted ambient air to the combustor reduces the temperature of the steam to a vapor for lowering the temperature of the part of the removed vapor utilized to initiate evaporation of the liquid in the processed mass.

6. The system set forth in claim 1 wherein the part of the removed vapor released to the ambient atmosphere is partly returned to the combustor for initiating the removal of the part of the vapor to initiate evaporation of the liquid in the processed mass.

7. The system set forth in claim 1 wherein the combustor operates to burn the solids in an atmosphere having a high percentage of water vapor and a temperature of about 1650° F. such that the carbon in the ash is converted to activated carbon.

8. In a system for disposing of sludge consisting of solids and liquids by using the sludge solids as a source of fuel for its own disposition by combustion thereof, the system comprising the steps of:

(a) providing a combustor with a primary combustion section and a base section for residual combustion;

(b) preparing a mass of liquified sludge for processing in the combustor by initiating burning of the sludge solids in the primary section of the combustor and advancing the ash by gravity into the base section while converting the liquid into a steam vapor;

(c) supplying ambient air to both the primary section and the base section of the combustor to support combustion;

(d) collecting the burned solids as ash from the base section of the combustor;

(e) passing the steam vapor in heat exchange relation with the ambient air supply for lowering the temperature of the steam vapor and elevating the temperature of the ambient air prior to supplying the ambient air to both of the combustor sections;

(f) directing the steam vapor from the heat exchange relationship with the ambient air in a path for extracting residual particulate matter and to a stack in preparation for release to ambient atmosphere; and (g) directing a portion of the heated ambient air to join with the released steam vapor at the stack for sanitizing the released steam vapor prior to release into the ambient atmosphere.

9. The system set forth in claim 8 wherein the supplying of ambient air to the base section is bubbled up through the burning material as it advances by gravity into the base section, thereby allowing the bubbling of the ambient air to continue the use of the material as a fuel and the formation of gaseous medium.

10. The system set forth in claim 8 wherein the collected ash from the base section of the combustor is analyzed for completeness of combustion, and means is provided to increase the residence time of the material in the base section of the combustor.

11. The system set forth in claim 8 wherein the combustion of the ground sludge in the combustor is consumed at an oxygen level of the order of between 5% to 9%, thereby converting the sludge by combustion to an ash residue having a high percentage of activated carbon.

12. In a system for reducing sludge material to ash by combustion of the sludge, the system comprising the steps of:

(a) processing the sludge material through a size reduction step;

(b) delivering the processed sludge to a combustion step;

(c) supplying ambient air to promote the combustion step;

(d) using the gaseous products of combustion as a heat source and discarding the residue ash;

(e) applying the gaseous heat source of the combustion products in steps to evaporate moisture in the sludge during processing of the sludge material and to preheat the ambient air supply;

(f) recovering particulate matter from the gaseous combustion products in advance of releasing the gases to the ambient atmosphere; and (g) sanitizing the gases released to ambient atmosphere by applying a portion of the preheated ambient air supply to mix with the gases released to ambient atmosphere.

* * * * *